US009865910B2

(12) United States Patent
Paulin et al.

(10) Patent No.: US 9,865,910 B2
(45) Date of Patent: Jan. 9, 2018

(54) OPTIMIZED COAXIAL TRANSMISSION LINE AND METHOD FOR OVERCOMING FLANGE REFLECTIONS

(71) Applicant: ELECTRONICS RESEARCH, INC., Chandler, IN (US)

(72) Inventors: Nicholas A. Paulin, Santa Claus, IN (US); Mark Steapleton, Newburgh, IN (US)

(73) Assignee: Electronics Research, Inc., Chandler, IN (US)

( * ) Notice: Subject to any disclaimer, the term of this patent is extended or adjusted under 35 U.S.C. 154(b) by 58 days.

(21) Appl. No.: 15/098,457

(22) Filed: Apr. 14, 2016

(65) Prior Publication Data

US 2017/0301973 A1 Oct. 19, 2017

(51) Int. Cl.
*H01P 3/06* (2006.01)

(52) U.S. Cl.
CPC ..... *H01P 3/06* (2013.01)

(58) Field of Classification Search
CPC ... H01P 3/06; H01P 1/045; H01P 5/02; H01R 24/44
USPC ..... 333/35, 244, 260, 245
See application file for complete search history.

(56) References Cited

U.S. PATENT DOCUMENTS 4,831,346 A * 5/1989 Brooker ..... H01B 11/1873 333/244
5,455,548 A 10/1995 Grandchamp et al.
5,999,071 A * 12/1999 Ostertag ..... H01P 3/06 333/245
6,816,040 B1 * 11/2004 Brown ..... H01P 3/06 333/243
6,972,648 B2 12/2005 Brown et al.

* cited by examiner

*Primary Examiner* — Stephen E Jones
(74) *Attorney, Agent, or Firm* — Martin IP Law Group; C. Richard Martin

(57) ABSTRACT

An optimized coaxial transmission line having joined segments of coaxial transmission lines is provided. First insulating supports positioned at flange joints within the joined segments are provided. Second insulating supports are positioned a distance x, where $$x = \frac{1}{4}\lambda + n \cdot \frac{1}{2}\lambda,$$

from the first insulating supports to cancel reflections created by the insulating supports. Preferably, x=¼λ., and the second insulating supports are positioned for one quarter of a wavelength at either FM frequencies, VHF frequencies, UHF frequencies, or IBOC frequencies. A method for optimizing a transmission line by frequency is also provided. First, segments of coaxial transmission lines are joined together, each segment having a first insulating support positioned at a flange joints within the joined segment. Next, a second insulating support is positioned along the length of each segment of coaxial transmission line a distance x from said first insulating support, where $$x = \frac{1}{4}\lambda + n \cdot \frac{1}{2}\lambda.$$

24 Claims, 10 Drawing Sheets

OPTIMIZED COAXIAL TRANSMISSION LINE AND METHOD FOR OVERCOMING FLANGE REFLECTIONS

FIELD OF THE INVENTION

The present invention relates to segmented coaxial transmission line. More particularly, the present invention relates to systems and methods for overcoming flange reflections in a length of coaxial transmission line.

BACKGROUND OF THE INVENTION

Rigid coaxial transmission line systems in broadcast are typically very long. It is because of the length of the transmission lines that interconnections between segments are needed. The flange connection is constructed using a pressure fitted connector and supporting insulator. Supporting insulators positioned throughout the transmission line create small reflections because they disturb the electric field of the applied traveling wave. The flange connections typically create the largest reflections. Because so many flanges are needed to construct such a system, the sum total of all of the flange reflections can add to create an unsuitable operating condition.

As discussed in U.S. Pat. No. 5,455,548 issued to Grandchamp et al., the conventional method for overcoming such a condition has been to provide various lengths of transmission lines for different frequency segments. As best shown in FIG. 1, such prior art transmission line inner conductor segments 10 typically have a male end 12 and a female end 14, which allows two segments to be connected together to create longer transmission line lengths. The connection between two adjacent segments of transmission lines 10, 10*a* is shown in FIG. 2. Such prior art transmission line segments 10 typically include an anchor insulating support 16 positioned near the male end 12 of the transmission line segment 10. Additional mechanical supports 18, 18' may be positioned along the axis of the transmission line segment 10. According to one preferred aspect of the invention, the mechanical supports 18, 18' are positioned at equidistant intervals from each other and equidistant from the anchor insulating support 16. Depending on the length of the transmission line segment 10, more than two additional insulating supports may be provided. FIG. 3 and FIG. 4 depict simulated return loss and VSWR, respectively, at frequencies of 40 MHz to 860 MHz. for a conventional transmission line utilizing segments of 20 ft. to achieve a total length of 400 ft.

Thus, there is a need for a system and method for overcoming flange reflections in coaxial transmission lines where the transmission line is formed of multiple coaxial line segments of substantially the same length.

SUMMARY OF THE INVENTION

The present invention overcomes the shortcomings of the prior art by providing a system and method for overcoming flange reflections in coaxial transmission lines where the transmission line is formed of multiple coaxial line segments. One practical purpose of the present invention is to permit reuse of existing transmission line outer conductors for an alternating frequency by compensating the inner conductors for flange reflections.

The goals of the present invention are accomplished by providing a second insulating support at a distance of ¼ wavelength at the desired frequency from the first insulating support at the flange joint to cancel the reflections of one another creating a reflection-less system at the desired frequency.

According to one aspect of the present invention, there is provided an optimized coaxial transmission line comprising joined segments of coaxial transmission lines, first insulating supports positioned at flange joints within the joined segments, and second insulating supports positioned a distance x from the first insulating supports, where $$x = \frac{1}{4}\lambda + n \cdot \frac{1}{2}\lambda.$$

The joined segments of coaxial transmission lines may be substantially the same length. Further, one or more mechanical supports may be positioned at equidistant intervals from each other and equidistant from the first insulating supports.

Preferably, the second insulating supports are positioned ¼λ from the first insulating supports at either FM frequencies, VHF frequencies, UHF frequencies, IBOC frequencies. The second insulating supports are also preferably positioned to cancel the connecting segments flange connection.

Another aspect of the invention is to provide first insulating supports and second insulating supports having identical reflection properties. To achieve this, the first insulating supports and the second insulating supports may formed of the same insulator material and/or the first insulating supports and the second insulating supports may be of similar dimensions.

According to a further aspect of the invention, each of the first insulating supports is positioned at a first end of each segment of rigid coaxial transmission line. Further, each of the second insulating supports associated with each first insulating support is positioned in the same segment of transmission line as the corresponding first insulating support. Alternatively, each of the second insulating supports associated with each first insulating support is positioned in the axially adjacent segment of transmission line connected to the first end of each segment of rigid coaxial transmission line.

Yet another aspect of the invention is a method for optimizing a transmission line by frequency comprising of the steps of joining segments of coaxial transmission lines, each segment having a first insulating support positioned at a flange joints within the joined segment, and positioning a second insulating support along the length of each segment of coaxial transmission line a distance x from said first insulating support, where $$x = \frac{1}{4}\lambda + n \cdot \frac{1}{2}\lambda.$$

The step of joining segments of coaxial transmission lines may further comprise joining segments of coaxial transmission lines of substantially the same length.

The step of positioning a second insulating support according to a further aspect of the invention may include positioning the second insulating support at one quarter of a wavelength at either FM frequencies, VHF frequencies, UHF frequencies, or IBOC frequencies. The step of positioning a second insulating support may include positioning the second insulating support to cancel the connecting segments flange connection. Similarly, the step of positioning a second insulating support may further include positioning a second insulating support having identical reflection properties to the first insulating support.

According to a further aspect of the invention, each of the first insulating supports is positioned at a first end of each segment of rigid coaxial transmission line. The step of positioning a second insulating support comprises positioning the second insulating support in the same segment of transmission line as the corresponding first insulating support. Alternatively, the step of positioning a second insulating support comprises positioning the second insulating support in the axially adjacent segment of transmission line connected to the first end of each segment of rigid coaxial transmission line.

These and other features, aspects and advantages of the present invention will become more clear after review of the drawings and detailed description herein.

DETAILED DESCRIPTION OF THE PREFERRED EMBODIMENTS

Figure 5:
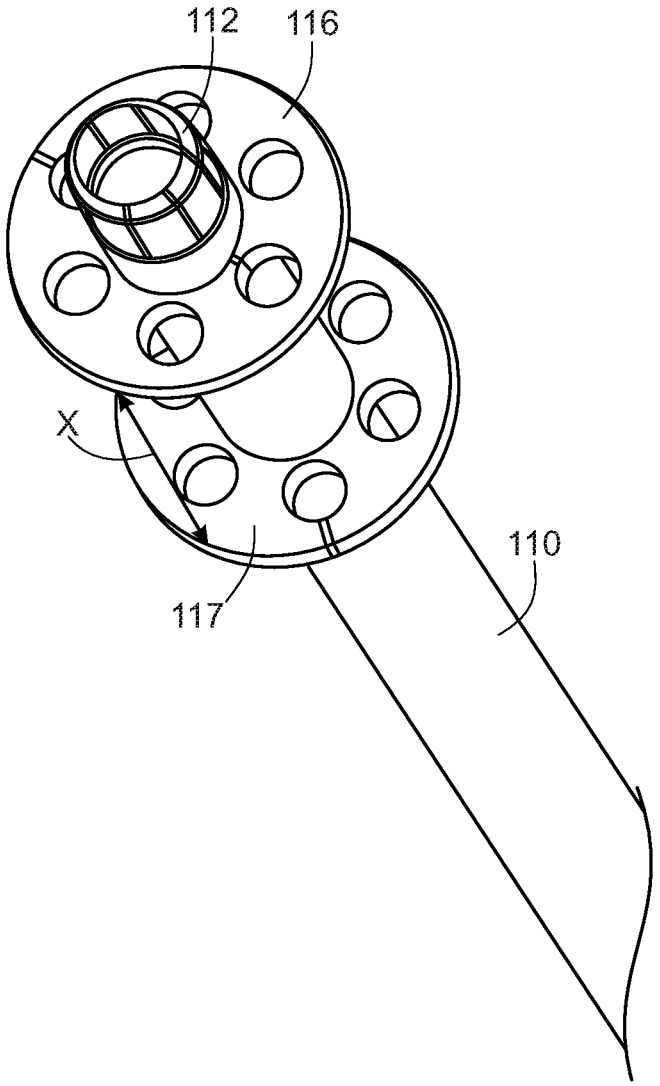
FIG. 5 is a perspective view of an inner conductor of a transmission line segment having a secondary insulator positioned near the male end of the transmission line segment according to a preferred embodiment of the present invention.
Figure 6:
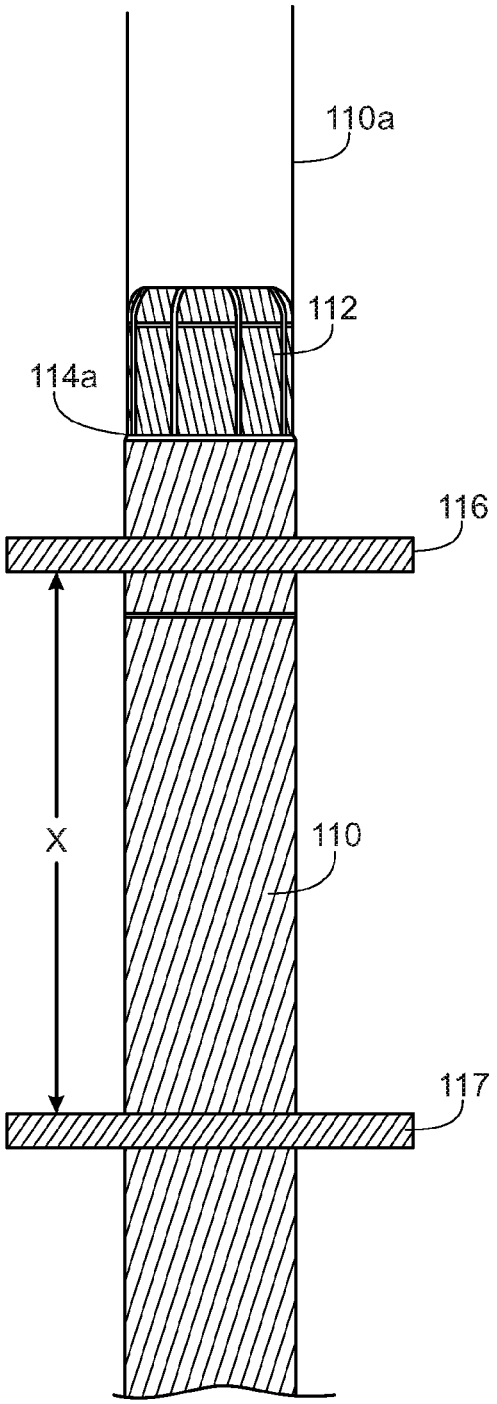
FIG. 6 is a side elevational view of the inner conductor of the transmission line segment of FIG. 5 shown connected to a second substantially similar transmission line segment according to a preferred embodiment of the present invention.
Figure 7:
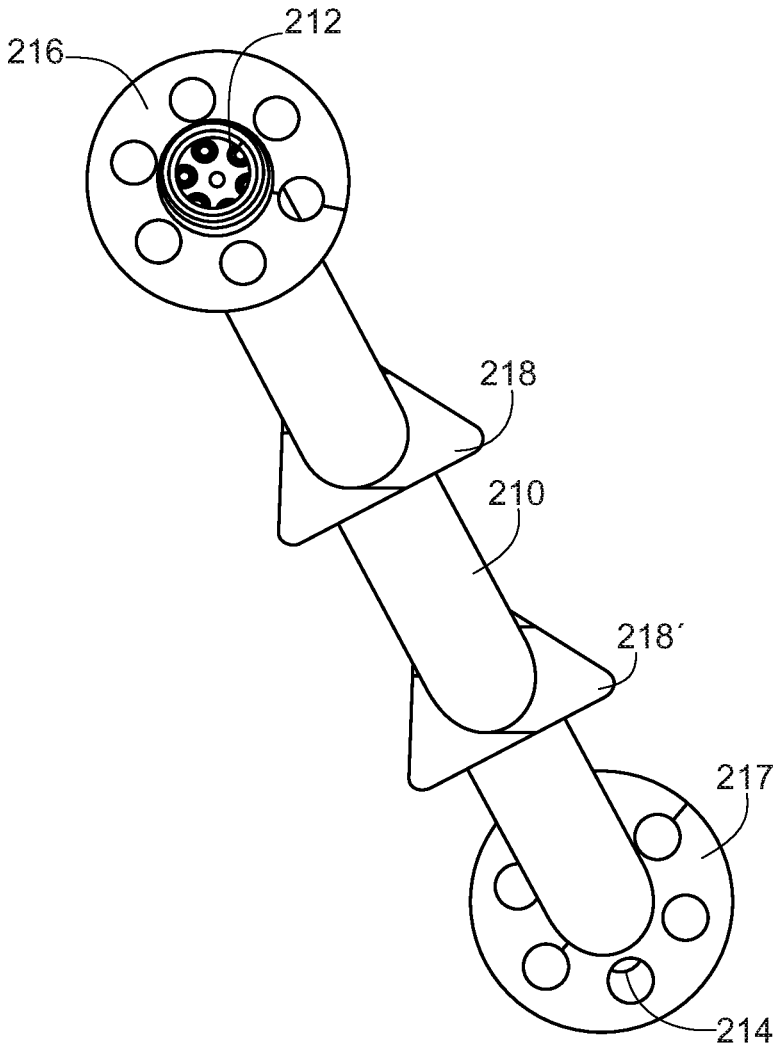
FIG. 7 is a perspective view of an inner conductor of a transmission line segment having a secondary insulator positioned near the female end of the transmission line segment according to an alternate preferred embodiment of the present invention.
Figure 8:
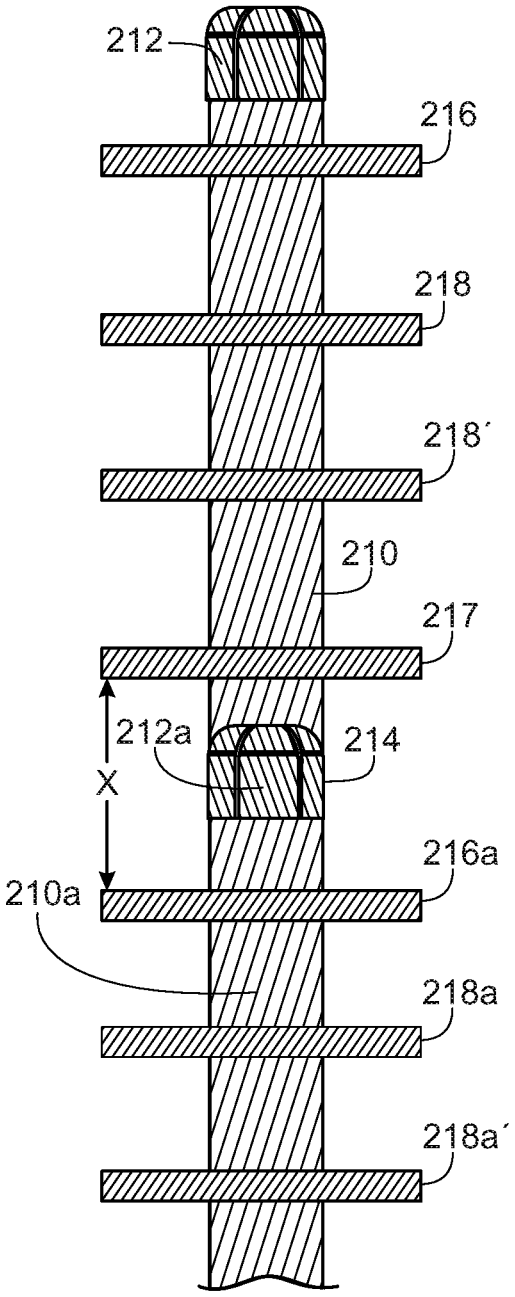
FIG. 8 is a side elevational view of the inner conductor of the transmission line segment of FIG. 7 shown connected to a second substantially similar transmission line segment according to an alternate preferred embodiment of the present invention.

The above discussed problem of reflection interference at the joints of segments of a length of coaxial transmission line is solved by the present invention by creating a cancellation effect between adjacent insulating supports. Two locations exist within a transmission line segment to create the optimum cancellation effect. As shown in FIG. 5 and FIG. 6, the first is one quarter wavelength from the male end. The second approach, as shown in FIG. 7 and FIG. 8, is to place the cancellation one quarter wavelength from the female end which compensates for any mating connection. Secondary locations may be used to accomplish a similar result at three quarters of one wavelength from the mating flange. Similarly, any location within a segment located at a position as defined by x, where $$x = \frac{1}{4}\lambda + n \cdot \frac{1}{2}\lambda$$

will accomplish similar results. However, ideal results will be realized with the closest practical proximity to the mating flange, which is ¼λ.

Referring now to FIG. 5 and FIG. 6, an optimized coaxial transmission line is provided comprising inner conductor segments 110 having a male end 112 and a female end 114, which allows two segments to be connected together to create longer transmission line lengths. The connection between two adjacent segments of transmission lines 110, 110*a* is shown in FIG. 6. Each transmission line segment 110 includes an anchor insulating support 116 positioned near the male end 112 of the transmission line segment 110.

A second insulating support 117 is positioned a distance x along the axis of the transmission line segment 110 from the first anchor insulating support 116, where $$x = \frac{1}{4}\lambda + n \cdot \frac{1}{2}\lambda.$$

N is any positive integer, and λ is the wavelength of the desired frequency. The preferred distance for x is ¼λ. However, secondary locations may be used to accomplish a similar result at three quarters of one wavelength from the mating flange, or any location within a segment located at a position as defined by the above formula. The secondary insulating support 117 should be placed ¼ wavelength from the first anchor insulating support 116 at the flange connection thus creating a multitude of reflections within the transmission system. Each ¼ wavelength pair of insulators will essentially cancel the reflections of one another creating a reflection-less system at the desired frequency ($f_o$), where c=speed of light.

$$\lambda = \frac{c}{f_o} \text{ meters Placement} = \frac{\lambda}{4} \text{ meters}$$

Figure 1:
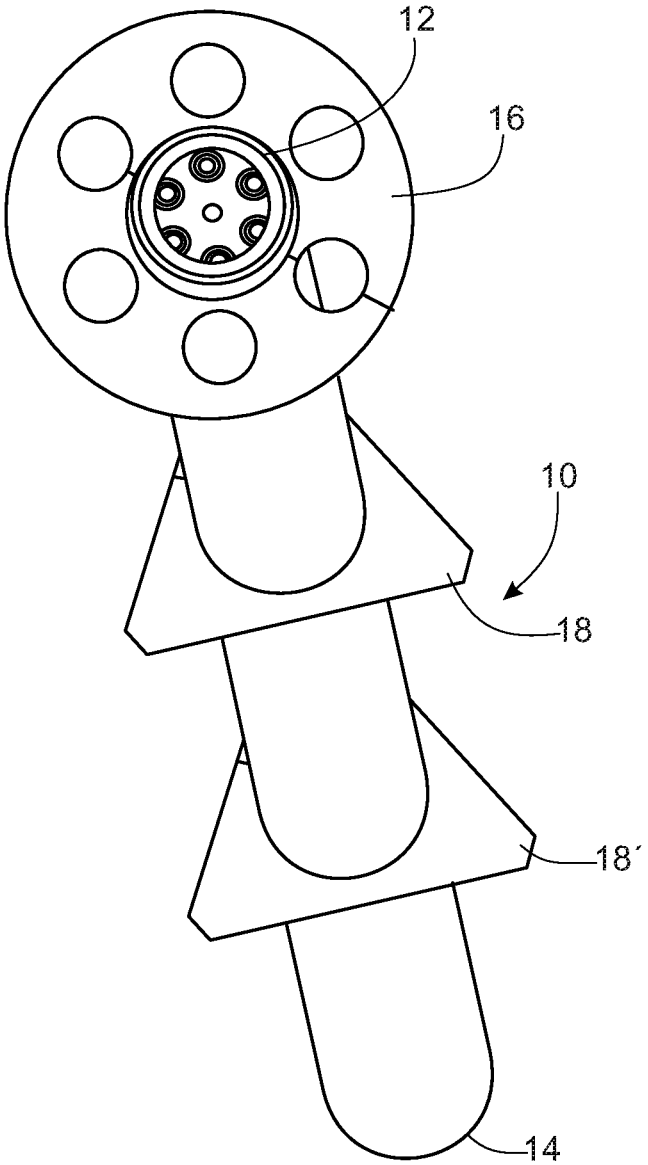
FIG. 1 PRIOR ART
FIG. 1 is a perspective view of an inner conductor of a conventional transmission line segment according to the prior art.
Figure 2:
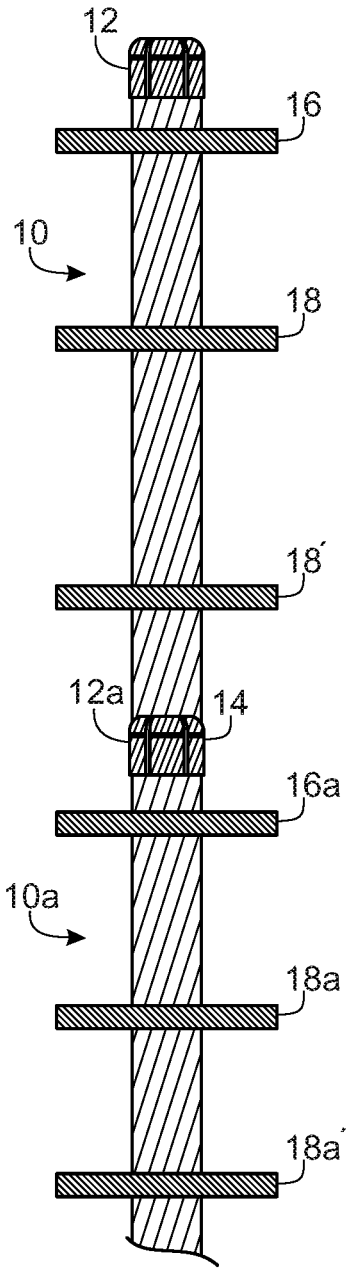
FIG. 2 PRIOR ART
FIG. 2 is a side elevational view of the inner conductor of the conventional transmission line segment of FIG. 1 shown connected to a second conventional transmission line segment of a different length according to the prior art.
Figure 3:
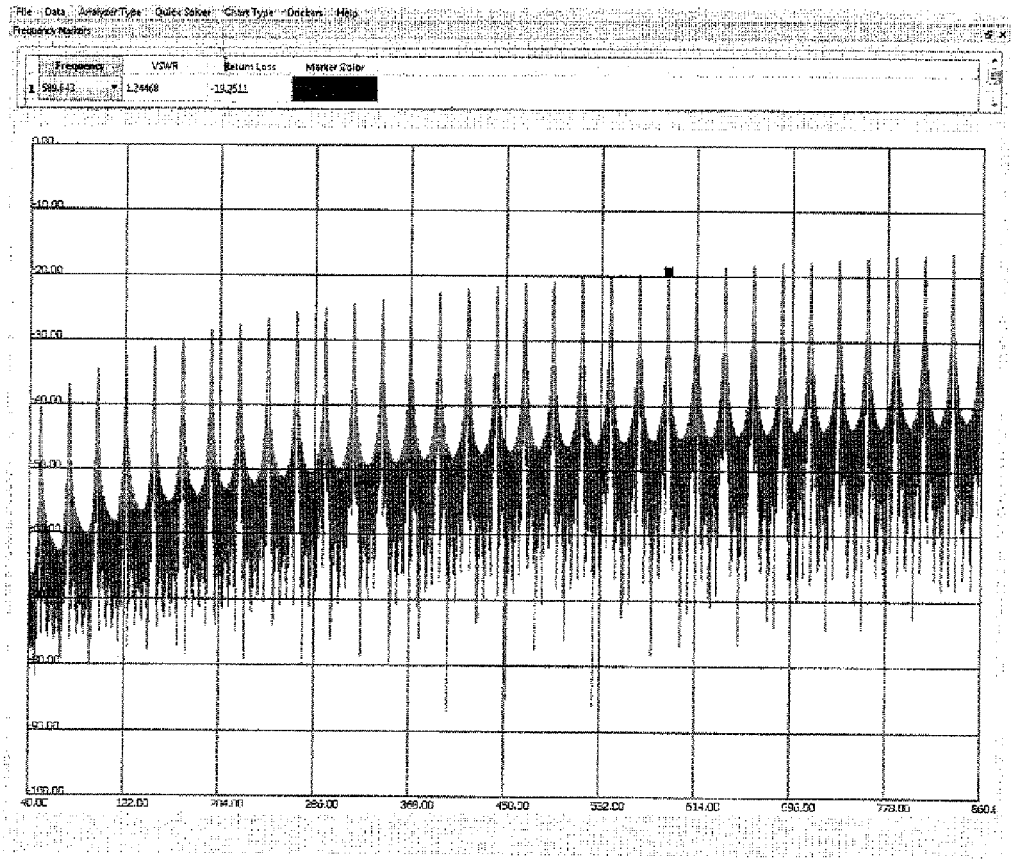
FIG. 3 PRIOR ART
FIG. 3 is a graph of the return loss at frequencies of 40 MHz to 860 MHz. for a conventional transmission line utilizing segments of 20 ft. to achieve a total length of 400 ft. according to the prior art.
Figure 4:
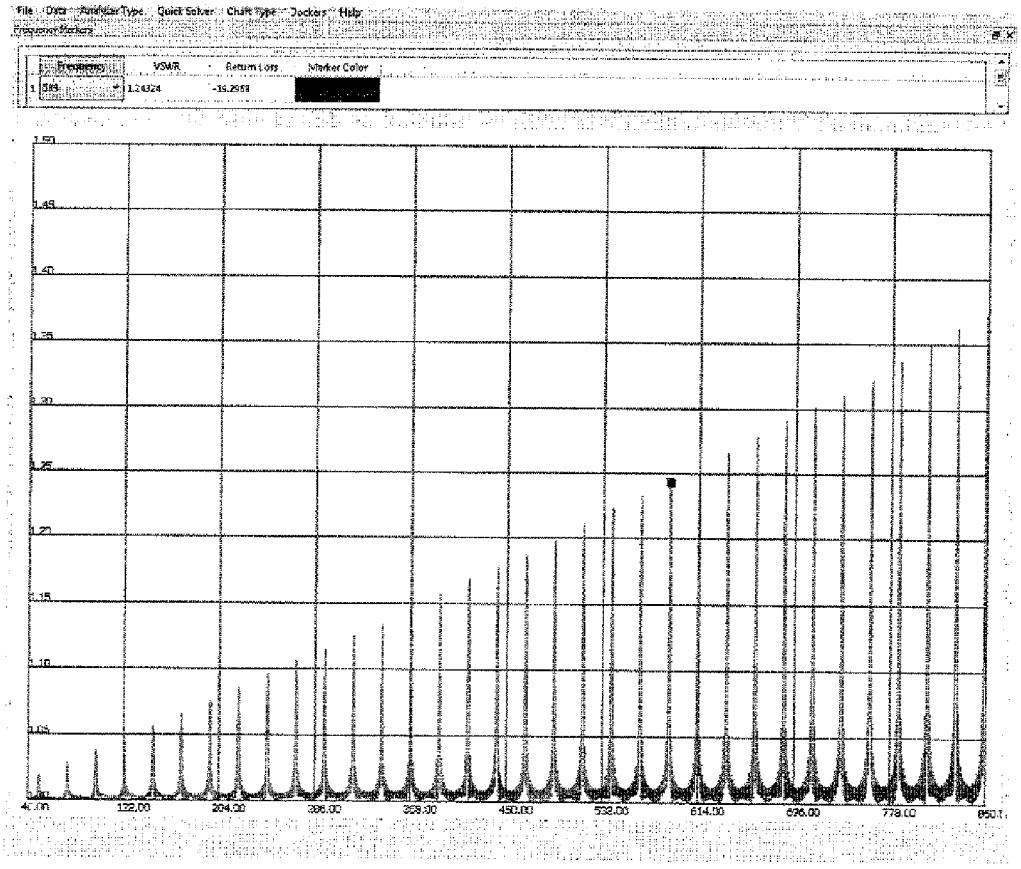
FIG. 4 PRIOR ART
FIG. 4 is a graph of the VSWR at frequencies of 40 MHz to 860 MHz. for a conventional transmission line utilizing segments of 20 ft. to achieve a total length of 400 ft. according to the prior art.

Additional mechanical and/or insulating supports, such as those shown in FIG. 1, may be positioned along the axis of the transmission line segment 110. According to one presently preferred embodiment of the invention, the additional mechanical supports are positioned at equidistant intervals from each other and equidistant from the anchor insulating support 116.

Reflections caused by flange connections can be cancelled by providing a secondary insulating support 117 with similar reflection characteristics to the anchor insulating support

116. The preferred method of compensation is to use anchor insulating supports 116 with identical reflection properties to the secondary insulating supports 117. This can be accomplished by using identical insulator materials and similar dimensions. It will be obvious to anyone skilled in the art that an alternative means of reflection or capacitive compensation media could be used such as a short metal transformer, often called a slug, an insulator of a material choice, or a device called a fine-tuner.

Referring now to FIG. 7 and FIG. 8, an optimized coaxial transmission line according to an alternative embodiment is provided comprising inner conductor segments 210 having a male end 212 and a female end 214, which allows two segments to effortlessly be connected together to create longer transmission line lengths. The connection between two adjacent segments of transmission lines 210, 210*a* is shown in FIG. 8. Each transmission line segment 210 includes an anchor insulating support 216 positioned near the male end 212 of the transmission line segment 210.

A second insulating support 217 is positioned a distance along the axis of the transmission line segments 210, 210*a* from the female end 214 such that the second insulating support 217 of transmission line segment 210 is a distance x from the first anchor insulating support 216*a* of the adjacent connected transmission line segment 210*a*, where $$x = \frac{1}{4}\lambda + n \cdot \frac{1}{2}\lambda.$$

As above, the preferred distance for x is ¼λ and secondary locations may be used to accomplish a similar result at three quarters of one wavelength from the mating flange, or any location within a segment located at a position as defined by the above formula. The secondary insulating support 217 should be placed ¼ wavelength from the first anchor insulating support 216*a* at the flange connection thus creating a multitude of reflections within the transmission system. Each ¼ wavelength pair of insulators will essentially cancel the reflections of one another creating a reflection-less system at the desired frequency ($f_o$), where c=speed of light.

$$\lambda = \frac{c}{f_o} \text{ meters Placement} = \frac{\lambda}{4} \text{ meters}$$

Mechanical supports 218, 218' may be positioned along the axis of the transmission line segment 210. According to a preferred embodiment of the invention, the mechanical supports 218, 218' are positioned at equidistant intervals from each other and equidistant from the anchor insulating support 216.

The result of the described compensation method is the complete cancellation of reflections that typically create conditions unsuitable for operation. This method of cancellation can be used to optimize any transmission line segment for any frequency of operation within the transmission lines prescribed useful frequency range.

Figure 9:
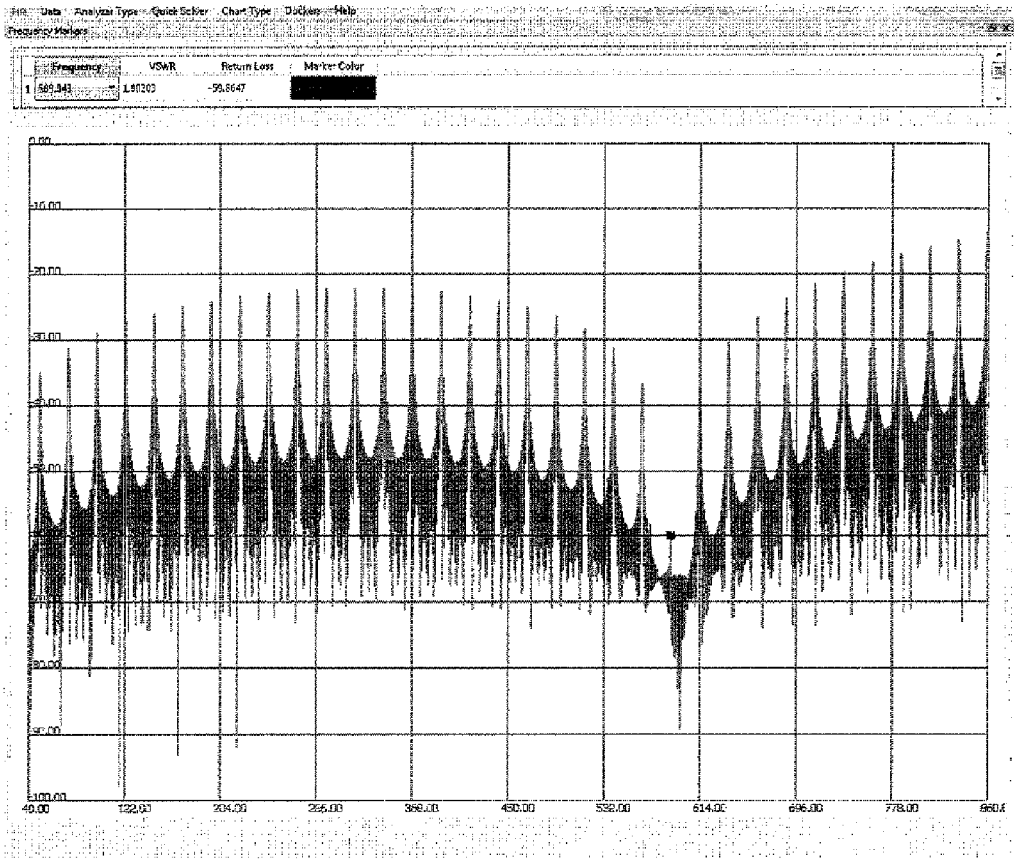
FIG. 9 is a graph of the return loss at frequencies of 40 MHz to 860 MHz for a transmission line optimized for transmission at 589 MHz and assembled according to the present invention utilizing segments of 20 ft. to achieve a total length of 400 ft.
Figure 10:
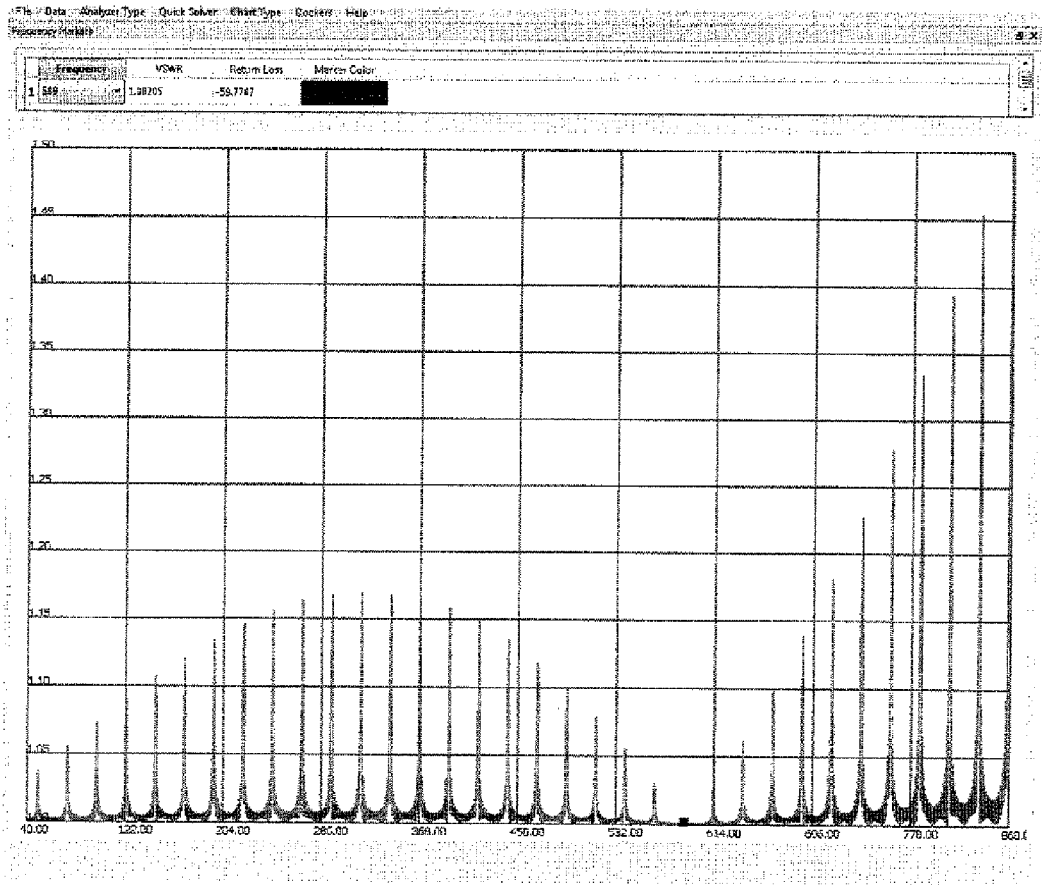
FIG. 10 is a graph of the VSWR at frequencies of 40 MHz to 860 MHz for a transmission line optimized for transmission at 589 MHz and assembled according to the present invention utilizing segments of 20 ft. to achieve a total length of 400 ft.

FIG. 9 and FIG. 10 depict the return loss of the disclosed transmission line utilizing segments of 20 ft. to achieve a total length of 400 ft. The return loss is shown using a starting frequency of 40 MHz and a stopping frequency of 860 MHz. The chosen optimization frequency of 589 MHz was used to show a worst case scenario and the improvement that is possible.

This detailed description, and particularly the specific details of the exemplary embodiments disclosed, is given primarily for clearness of understanding and no unnecessary limitations are to be understood therefrom, for modifications will become evident to those skilled in the art upon reading this disclosure and may be made without departing from the spirit or scope of the claimed invention.

We claim:

1. An optimized coaxial transmission line comprising:
joined segments of coaxial transmission lines;
first insulating supports positioned at flange joints within the joined segments; and
second insulating supports positioned a distance x from said first insulating supports, where $$x = \frac{1}{4}\lambda + n \cdot \frac{1}{2}\lambda,$$

wherein n is a non-negative integer.

2. The optimized coaxial transmission line of claim 1 wherein the joined segments of coaxial transmission lines are substantially the same length.

3. The optimized coaxial transmission line of claim 1 further comprising one or more mechanical supports positioned at equidistant intervals from each other and equidistant from the first insulating supports.

4. The optimized coaxial transmission line of claim 1 wherein n=0 and x=¼λ.

5. The optimized coaxial transmission line of claim 4 wherein the second insulating supports are positioned for one quarter of a wavelength at FM frequencies.

6. The optimized coaxial transmission line of claim 4 wherein the second insulating supports are positioned for one quarter of a wavelength at VHF frequencies.

7. The optimized coaxial transmission line of claim 4 wherein the second insulating supports are positioned for one quarter of a wavelength at UHF frequencies.

8. The optimized coaxial transmission line of claim 4 wherein the second insulating supports are positioned for one quarter of a wavelength at IBOC frequencies.

9. The optimized coaxial transmission line of claim 1 wherein the second insulating support is positioned to cancel the connecting segments flange connection.

10. The optimized coaxial transmission line of claim 1 wherein the first insulating supports and the second insulating supports have identical reflection properties.

11. The optimized coaxial transmission line of claim 10 wherein the first insulating supports and the second insulating supports are formed of the same insulator material.

12. The optimized coaxial transmission line of claim 11 wherein the first insulating supports and the second insulating supports are of similar dimensions.

13. The optimized coaxial transmission line of claim 1 wherein each of the first insulating supports is positioned at a first end of each segment of rigid coaxial transmission line, and each of said second insulating supports associated with each first insulating support is positioned in the same segment of transmission line as the corresponding first insulating support.

14. The optimized coaxial transmission line of claim 1 wherein each of the first insulating supports is positioned at a first end of each segment of rigid coaxial transmission line, and each of said second insulating supports associated with each first insulating support is positioned in the axially adjacent segment of transmission line connected to the first end of each segment of rigid coaxial transmission line.

15. A method for optimizing the frequency of a transmission line having joined segments of coaxial transmission lines, each segment having a first insulating support positioned at a flange joint within the joined segment, the method comprising the step of positioning a second insulating support along the length of each segment of coaxial transmission line a distance x from said first insulating support, where $$x = \frac{1}{4}\lambda + n \cdot \frac{1}{2}\lambda,$$

wherein n is a non-negative integer.

16. The method for optimizing a transmission line by frequency of claim 15 wherein the step of joining segments of coaxial transmission lines comprises joining segments of coaxial transmission lines of substantially the same length.

17. The method for optimizing a transmission line by frequency of claim 15 wherein the step of positioning a second insulating support comprises positioning the second insulating support at one quarter of a wavelength at FM frequencies.

18. The method for optimizing a transmission line by frequency of claim 15 wherein the step of positioning a second insulating support comprises positioning the second insulating support at one quarter of a wavelength at VHF frequencies.

19. The method for optimizing a transmission line by frequency of claim 15 wherein the step of positioning a second insulating support comprises positioning the second insulating support at one quarter of a wavelength at UHF frequencies.

20. The method for optimizing a transmission line by frequency of claim 15 wherein the step of positioning a second insulating support comprises positioning the second insulating support at one quarter of a wavelength at IBOC frequencies.

21. The method for optimizing a transmission line by frequency of claim 15 wherein the step of positioning a second insulating support comprises positioning the second insulating support to cancel the connecting segments flange connection.

22. The method for optimizing a transmission line by frequency of claim 15 wherein the step of positioning a second insulating support comprises positioning a second insulating support having identical reflection properties to the first insulating support.

23. The method for optimizing a transmission line by frequency of claim 15 wherein each of the first insulating supports is positioned at a first end of each segment of rigid coaxial transmission line, and the step of positioning a second insulating support comprises positioning the second insulating support in the same segment of transmission line as the corresponding first insulating support.

24. The method for optimizing a transmission line by frequency of claim 15 wherein each of the first insulating supports is positioned at a first end of each segment of rigid coaxial transmission line, and the step of positioning a second insulating support comprises positioning the second insulating support in the axially adjacent segment of transmission line connected to the first end of each segment of rigid coaxial transmission line.

* * * * *